US009604453B2

(12) United States Patent
Yamato

(10) Patent No.: US 9,604,453 B2
(45) Date of Patent: Mar. 28, 2017

(54) ELEMENT SUBSTRATE, LIQUID DISCHARGE HEAD, AND PRINTING APPARATUS

(71) Applicant: CANON KABUSHIKI KAISHA, Tokyo (JP)

(72) Inventor: Hidenori Yamato, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/982,599

(22) Filed: Dec. 29, 2015

(65) Prior Publication Data

US 2016/0193834 A1 Jul. 7, 2016

(30) Foreign Application Priority Data

Jan. 6, 2015 (JP) ..... 2015-001072

(51) Int. Cl.
*B41J 2/045* (2006.01)
*B41J 2/14* (2006.01)

(52) U.S. Cl.
CPC ..... *B41J 2/04541* (2013.01); *B41J 2/0458* (2013.01); *B41J 2/04543* (2013.01); *B41J 2/14072* (2013.01); *B41J 2202/20* (2013.01)

(58) Field of Classification Search
CPC B41J 2/04541; B41J 2/04543; B41J 2/14072; B41J 2/0458; B41J 2202/20
See application file for complete search history.

(56) References Cited

U.S. PATENT DOCUMENTS 5,144,341 A * 9/1992 El Haten ..... B41J 2/04541 347/12
6,388,691 B1 * 5/2002 Maeyama ..... B41J 2/36 347/183
6,409,315 B2 6/2002 Komuro
6,501,108 B1 12/2002 Suzuki et al.
7,806,495 B2 10/2010 Kasai
8,147,039 B2 4/2012 Kurokawa et al.
(Continued)

FOREIGN PATENT DOCUMENTS

JP 7-314658 A 12/1995
JP 07314658 A * 12/1995
(Continued)

OTHER PUBLICATIONS

U.S. Appl. No. 14/966,615, filed Dec. 11, 2015.

*Primary Examiner* — Justin Seo
(74) *Attorney, Agent, or Firm* — Fitzpatrick, Cella, Harper & Scinto

(57) ABSTRACT

According to one embodiment, an element substrate includes: heater arrays each having heaters arranged in parallel; corresponding transistors for driving the heaters included in the heater arrays; a first pad for supplying a voltage to be applied to the heaters; and a second pad for grounding the heaters. The element substrate is provided with a first wiring for connecting the first pad to the heaters, and a second wiring for connecting the heaters to the second pad. Furthermore, sizes of the transistors included in a heater array, of the heater arrays, provided at a position where intervals with respect to the first pad and the second pad are relatively large are set to be larger than the sizes of the transistors included in a heater array provided at a position where the intervals are relatively small.

14 Claims, 11 Drawing Sheets

(56) References Cited

U.S. PATENT DOCUMENTS

| | | | | |
|---|---|---|---|---|
| 9,102,146 | B2 * | 8/2015 | Yamato | B41J 2/04541 |
| 2001/0052916 | A1 | 12/2001 | Komuro | |
| 2002/0125511 | A1 * | 9/2002 | Shimotsusa | B41J 2/14072 257/288 |
| 2005/0052499 | A1 * | 3/2005 | Oomura | B41J 2/04531 347/58 |
| 2005/0140736 | A1 * | 6/2005 | Imanaka | B41J 2/04506 347/58 |
| 2005/0179738 | A1 * | 8/2005 | Mihara | B41J 2/14072 347/57 |
| 2005/0206685 | A1 | 9/2005 | Hirayama | |
| 2005/0212857 | A1 | 9/2005 | Hirayama | |
| 2005/0264608 | A1 * | 12/2005 | Hirayama | B41J 2/04541 347/54 |
| 2006/0284909 | A1 * | 12/2006 | Kasai | B41J 2/04521 347/9 |
| 2007/0046738 | A1 | 3/2007 | Yagi et al. | |
| 2008/0084453 | A1 * | 4/2008 | Sheahan | B41J 2/0451 347/54 |
| 2009/0174753 | A1 | 7/2009 | Kurokawa et al. | |

FOREIGN PATENT DOCUMENTS

| | | | |
|---|---|---|---|
| JP | 10-44416 | A | 2/1998 |
| JP | 2004-243542 | A | 9/2004 |
| JP | 2009-160883 | A | 7/2009 |
| JP | 2010-505642 | T | 2/2010 |
| WO | 2008/043120 | A1 | 4/2008 |

* cited by examiner

ELEMENT SUBSTRATE, LIQUID DISCHARGE HEAD, AND PRINTING APPARATUS

BACKGROUND OF THE INVENTION

Field of the Invention

The present invention relates to an element substrate, a liquid discharge head, and a printing apparatus, and particularly to, for example, an element substrate integrating a plurality of electrothermal transducers and driving circuits for driving the transducers, a liquid discharge head integrating the element substrate, and a printing apparatus using the head as a printhead.

Description of the Related Art

As a method of driving an inkjet printhead (to be referred to as a printhead hereinafter), there is known a thermal driving method in which print elements are provided at portions communicating with orifices for discharging ink droplets, a current is supplied to the print elements to generate heat, and then ink droplets are discharged by film boiling of ink. Power is supplied to print elements via the electrode pad of an element substrate integrated in the printhead, and a current is supplied to any desired print elements by time-divisional drive.

Since energy necessary for discharge is different depending on the ink viscosity and discharge amount, it is necessary to optimally design a current to be supplied to the print elements for each ink type. Japanese Patent Laid-Open No. 7-314658 discloses an arrangement for preventing the image quality from degrading due to color difference by changing the plane area of a transistor depending on an ink color.

Furthermore, if the wiring resistance values of a ground wiring and a power supply wiring for supplying power to print elements are different between the plurality of print elements, a voltages applied to each print element changes, resulting in different discharge characteristics. To perform stable ink discharge and improve the image quality of a print image, it is necessary to apply a constant voltage to the plurality of print elements, and it is thus necessary to reduce a change in voltage caused by the resistance difference of the power supply wiring in the element substrate.

Japanese Patent Laid-Open No. 10-044416 discloses an arrangement in which a wiring for applying an externally supplied voltage is divided into a plurality of wirings to equalize voltage drops from an electrode pad to respective print elements. It is possible to divide a plurality of print elements into a plurality of groups, and equalize the resistance values of the divided wirings, thereby equalizing voltages applied to the print elements of each group. Furthermore, it is possible to eliminate the difference between a voltage drop when driving one print element and that when driving all the print elements by time-divisional drive of driving only one print element in one group at once.

In recent years, there is proposed a full-line printhead whose printing width corresponds to the width of a print medium by arranging a plurality of element substrates. The full-line printhead can perform high-speed printing, and is thus used in a printing apparatus for professional use or industrial use.

FIG. 11 is a view showing the arrangement of a full-line printhead formed by arranging a plurality of element substrates in line in a printing width direction.

As shown in FIG. 11, each element substrate 502 having a shape of a parallelogram includes a plurality of print element arrays 504, and respective signals and power are supplied from a printing apparatus (not shown) to electrode pads 505 via a connector 503 and head wirings 506. Furthermore, by connecting and arranging the element substrates 502 (in this example, four element substrates 502) in line, it is possible to decrease the size (H) of one side of the printhead 501. Since the connected portion of each element substrate 502 has a shape having an angle in the printing width direction (W), and the plurality of element substrates 502 can be arranged close to each other, it is possible to reduce the number of print elements arranged to overlap each other in the connected portions of the element substrates 502. Note that to connect and arrange the element substrates 502 in line, the electrode pads 505 need to be arranged around an end portion of each element substrate in parallel to the print element arrays 504.

FIG. 12 is a view showing the arrangement of a full-line printhead formed by arranging a plurality of element substrates in a staggered pattern in the printing width direction. Note that in FIG. 12, the same reference numerals as in FIG. 11 denote the same portions and a description thereof will be omitted.

To obtain satisfactory discharge characteristics, it is necessary to arrange neighboring element substrates close to each other even in the arrangement in which the element substrates 502 are arranged in a staggered pattern. With an arrangement in which the electrode pads 505 are arranged in a direction perpendicular to the direction of the print element arrays 504, it is impossible to ensure a region for head wirings from the electrode pads 505 to the connector 503. Therefore, as shown in FIG. 12, even in the arrangement in which the element substrates are arranged in a staggered pattern, it is necessary to arrange the electrode pads 505 in parallel to the print element arrays 504.

As described above, in the arrangement in which the electrode pads are arranged in parallel to the print element arrays, it is possible to shorten the length of a power supply wiring by arranging the power supply wiring between ink supply ports for individually supplying ink to the print elements. In this way, by reducing a voltage drop caused by the resistance of the power supply wiring in the element substrate, it is possible to increase the speed of high-quality printing, and improve the durability of the printhead.

However, the distance between the ink supply ports depends on the arrangement pitch of the print elements. Therefore, unlike Japanese Patent Laid-Open No. 7-314658, it is impossible to divide a power supply wiring into a plurality of wirings to fit in the wiring resistances. Consequently, the power supply wiring resistances to the print elements are different for each print element array, and voltages applied to the corresponding print elements are different.

SUMMARY OF THE INVENTION

Accordingly, the present invention is conceived as a response to the above-described disadvantages of the conventional art.

For example, an element substrate, a liquid discharge head, and a printing apparatus according to this invention are capable of eliminating the influence of a wiring resistance difference to apply a constant voltage to heaters to be driven.

According to one aspect of the present invention, there is provided an element substrate comprising a plurality of heater arrays arranged in parallel and each formed by arranging a plurality of heaters, a plurality of transistors corresponding to the plurality of heaters included in the plurality of heater arrays and configured to drive the plurality of heaters, a first electrode pad configured to supply a voltage to be applied to the plurality of heaters, a second electrode pad configured to ground the plurality of heaters, a first wiring configured to connect the first electrode pad to the plurality of heaters, and a second wiring configured to connect the plurality of heaters to the second electrode pad, wherein sizes of the plurality of transistors included in the heater array, of the plurality of heater arrays, provided at a position where intervals with respect to the first electrode pad and the second electrode pad are relatively large are set to be larger than sizes of the plurality of transistors included in the heater array provided at a position where the intervals with respect to the first electrode pad and the second electrode pad are relatively small.

According to another aspect of the present invention, there is provided a full-line printhead wherein a liquid discharge head having as a feature to integrate the element substrate having the above arrangement and form a head for discharging a liquid is formed as an inkjet printhead for discharging ink to perform printing, and a plurality of element substrates having the above arrangement are arranged in the direction of the plurality of heater arrays to have a printing width corresponding to the width of a print medium.

According to still another aspect of the present invention, there is provided a printing apparatus for performing printing using the inkjet printhead or the full-line printhead.

The invention is particularly advantageous since it is possible to obtain an effect capable of eliminating a change in voltage caused by a wiring resistance difference in the element substrate, and applying a constant voltage to the heaters. Furthermore, it is possible to reduce the size of an element substrate by decreasing the size of the transistor of a print element positioned in a portion where the wiring resistance is low and increasing the size of the transistor of a print element positioned in a portion where the wiring resistance is high.

Note that it is also possible to obtain an effect of improving the image quality of a print image in a case where the element substrate is used as a printhead.

Further features of the present invention will become apparent from the following description of exemplary embodiments (with reference to the attached drawings).

DESCRIPTION OF THE EMBODIMENTS

Exemplary embodiments of the present invention will now be described in detail in accordance with the accompanying drawings. However, the scope of the invention is not limited to the relative layout and the like of constituent elements described in the embodiments unless otherwise specified.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

In addition, "a print element" is a general term for a nozzle (or orifice), a channel communicating with the nozzle, and a device for generating energy to be used to discharge ink, unless otherwise specified.

In an inkjet printhead (to be referred to as a printhead hereinafter) which is the most important characteristic feature of the present invention, a plurality of print elements and driving circuits for driving the print elements are integrated in an element substrate of the print head. As will be apparent from the following description, the printhead has a structure of incorporating a plurality of element substrates and cascade-connecting the element substrates. Therefore, the printhead can achieve a relatively large printing width. The printhead is used for not only a general serial type printing apparatus but also a printing apparatus including a full-line printhead whose printing width corresponds to the width of a print medium. Furthermore, the printhead is used for a large format printer using a print medium of a large size such as A0 or B0 size among serial type printing apparatuses.

A printing apparatus in which a printhead according to the present invention is used will be described first.

<Printing Apparatus with Full-Line Printhead (FIG. 1)>

Figure 1:
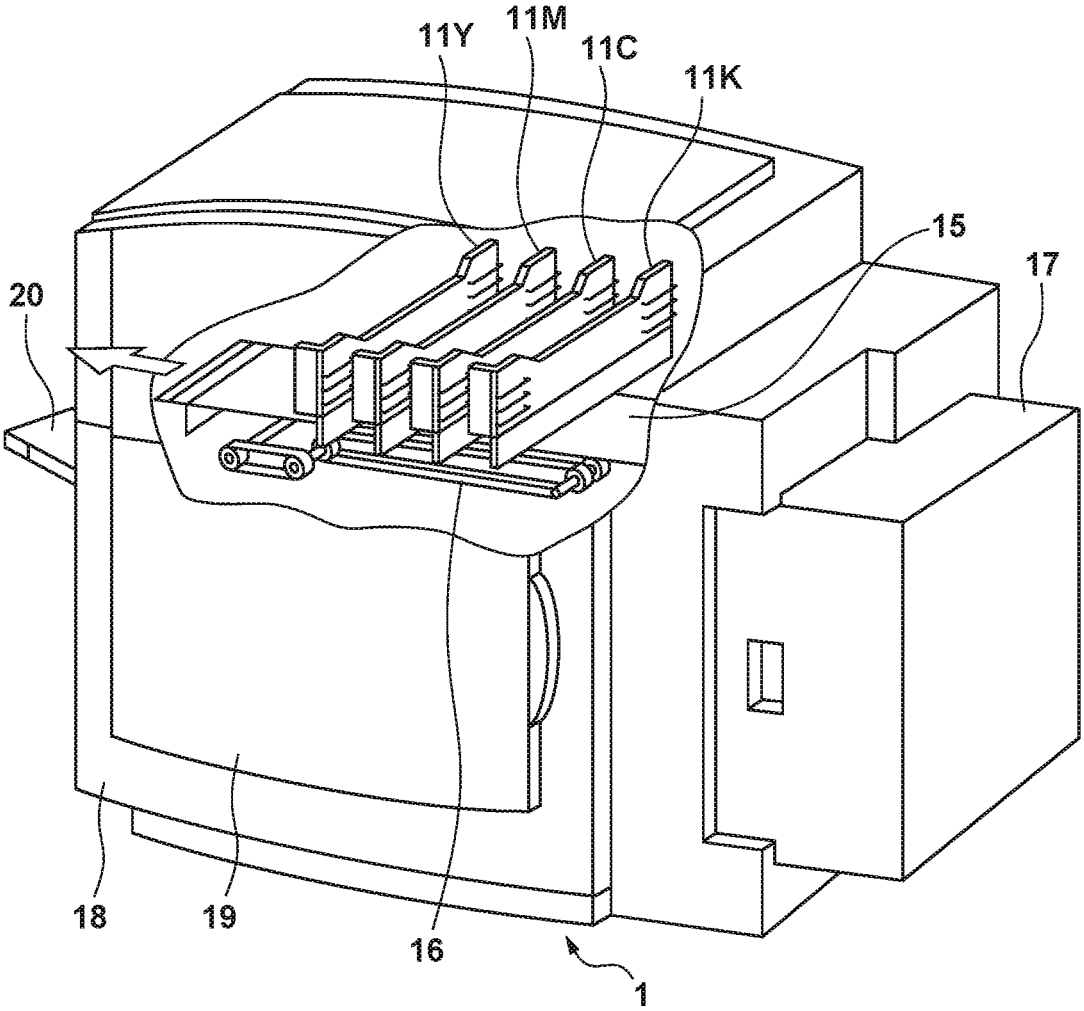
FIG. 1 is a perspective view for explaining the structure of a printing apparatus including a full-line printhead as an exemplary embodiment of the present invention.

FIG. 1 is a perspective view for explaining the structure of a printing apparatus 1 including full-line inkjet printheads (to be referred to as printheads hereinafter) 11K, 11C, 11M, and 11Y, and a recovery unit for always guaranteeing stable ink discharge.

In the printing apparatus 1, a printing sheet 15 is supplied from a feeder unit 17 to the printing positions of the printheads, and conveyed by a conveyance unit 16 arranged in a housing 18 of the printing apparatus.

In printing an image on the printing sheet 15, while conveying the printing sheet 15, the printhead 11K discharges black (K) ink when the reference position of the printing sheet 15 reaches a position below the printhead 11K for discharging black ink. Similarly, when the printing sheet 15 sequentially reaches the reference position of the printhead 11C for discharging cyan (C) ink, that of the printhead 11M for discharging magenta (M) ink, and that of the printhead 11Y for discharging yellow (Y) ink, the printheads 11C, 11M, and 11Y discharge the respective color inks, thereby forming a color image. The printing sheet 15 on which the image has been printed is discharged to a stacker tray 20 and stacked.

The printing apparatus 1 further includes the conveyance unit 16, and ink cartridges (not shown) exchangeable for the respective inks to supply inks to the printheads 11K, 11C, 11M, and 11Y. The printing apparatus 1 also includes pump units (not shown) for ink supply and recovery operations for the printheads 11K, 11C, 11M, and 11Y, and a control substrate (not shown) for controlling the overall printing apparatus 1. A front door 19 is an opening/closing door for exchanging the ink cartridge.

<Printing Apparatus Using Large-Size Print Medium (FIGS. 2A and 2B)>

Figure 2A:
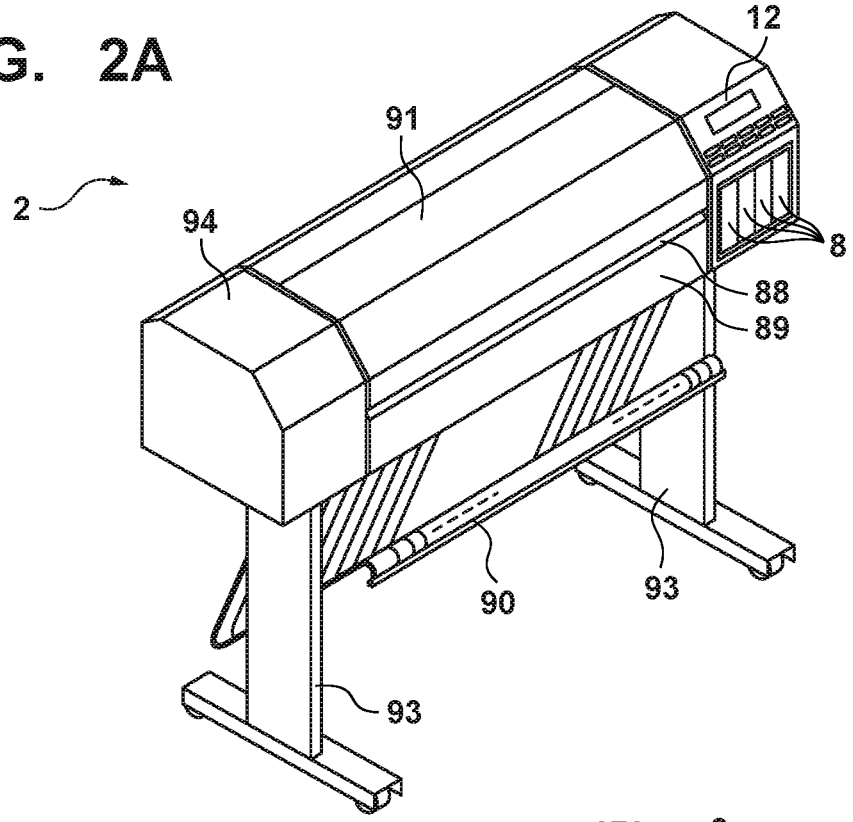
FIGS. 2A and 2B are perspective views each showing the outer appearance of the printing apparatus using A0- and B0-size print media.
Figure 2B:
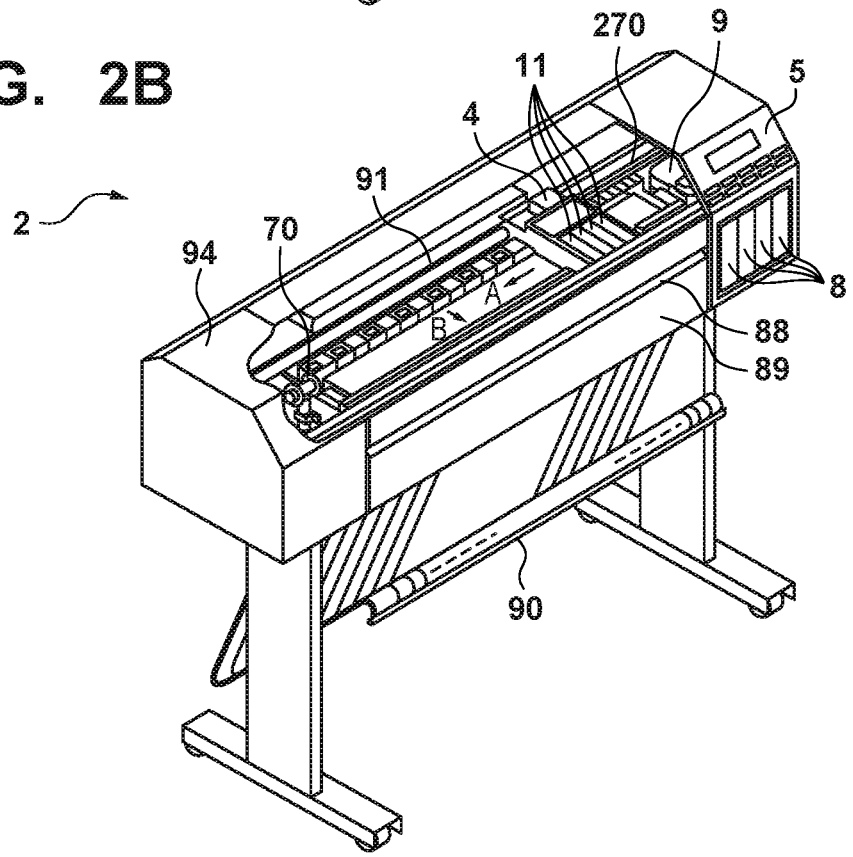

FIGS. 2A and 2B are perspective views each showing the outer appearance of a printing apparatus using A0- and B0-size print media. FIG. 2B is a perspective view showing a state in which the upper cover of the printing apparatus shown in FIG. 2A is removed.

As shown in FIG. 2A, a printing apparatus 2 has a manual insertion port 88 on the front surface, and a roll paper cassette 89 which can open to the front side is arranged below the manual insertion port 88. A print medium such as printing paper is supplied from the manual insertion port 88 or roll paper cassette 89 into the printing apparatus. The printing apparatus 2 includes an apparatus main body 94 supported by two legs 93, a stacker 90 in which a discharged print medium is stacked, and an openable/closable see-through upper cover 91. An operation panel 12, ink supply units, and ink tanks are disposed on the right side of the apparatus main body 94.

As shown in FIG. 2B, the printing apparatus 2 further includes a conveyance roller 70 for conveying a print medium in a direction (sub-scanning direction) indicated by an arrow B, and a carriage 4 which is guided and supported to be able to reciprocate in the widthwise direction (indicated by an arrow A: main scanning direction) of the print medium. The printing apparatus 2 also includes a carriage motor (not shown) for reciprocating the carriage 4 in the direction indicated by the arrow A, a carriage belt (to be referred to as a belt hereinafter) 270, and printheads 11 mounted on the carriage 4. The printing apparatus 2 includes a suction ink recovery unit 9 which supplies ink and cancels an ink discharge failure caused by clogging of the orifice of the printhead 11 or the like.

In this printing apparatus, the printheads 11 formed from four heads in correspondence with four color inks are mounted on the carriage 4 to print in color on a print medium. That is, the printheads 11 are formed from, for example, a K (black) head for discharging K ink, a C (Cyan) head for discharging C ink, an M (Magenta) head for discharging M ink, and a Y (Yellow) head for discharging Y ink.

When printing on a print medium by the above arrangement, the conveyance roller 70 conveys the print medium to a predetermined printing start position. Then, the carriage 4 repeats an operation of causing the printhead 11 to scan in the main scanning direction and an operation of causing the conveyance roller 70 to convey the print medium in the sub-scanning direction, thereby printing on the entire print medium.

More specifically, the belt 270 and a carriage motor (not shown) move the carriage 4 in the direction indicated by the arrow A shown in FIG. 2B, thereby printing on a print medium. When the carriage 4 returns to a position (home position) before scanning, the conveyance roller conveys the print medium in the sub-scanning direction (the direction indicated by the arrow B shown in FIG. 2B), and the carriage then scans again in the direction indicated by the arrow A in FIG. 2B. In this way, an image, character, or the like is printed on the print medium. After this operation is repeated to end printing of one print medium, the print medium is discharged to the stacker 90, thereby completing printing of one print medium.

<Description of Control Arrangement (FIG. 3)>

Next, a control arrangement for executing printing control of the printing apparatus described with reference to FIG. 1 or FIGS. 2A and 2B will be explained.

Figure 3:
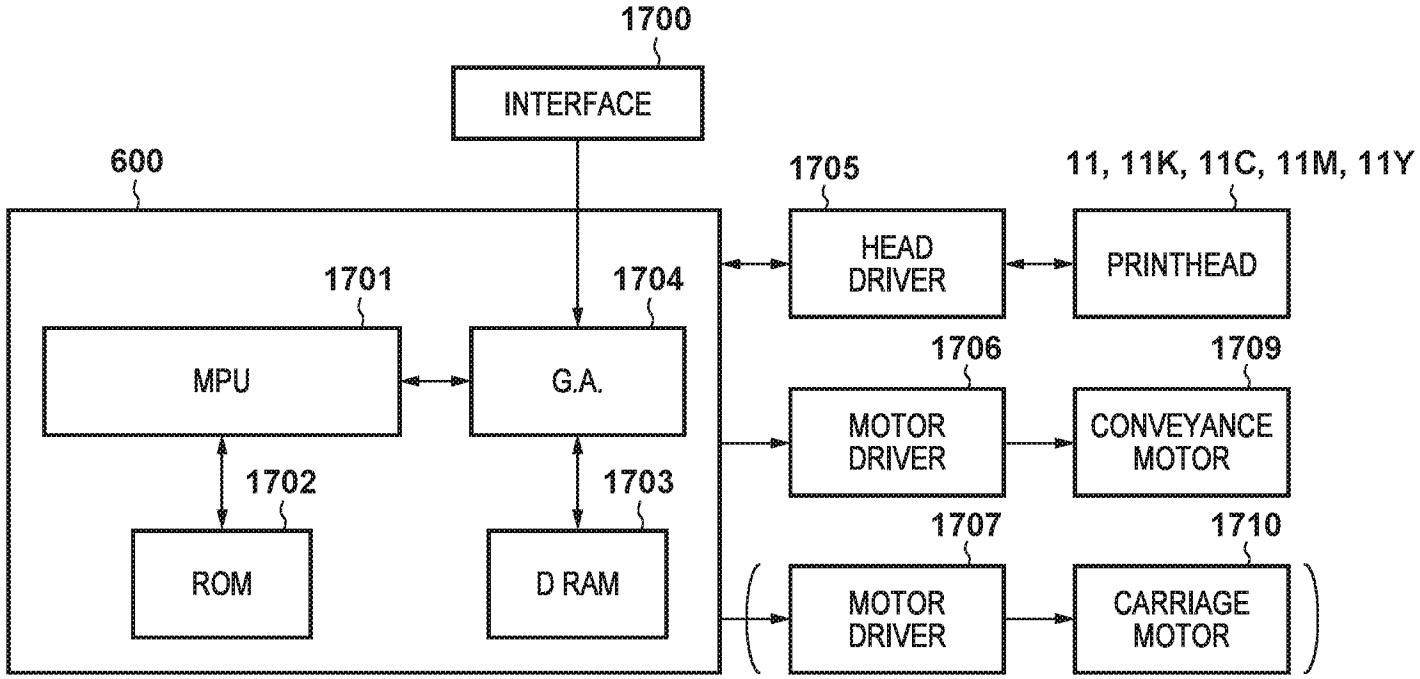
FIG. 3 is a block diagram showing the control arrangement of the printing apparatus shown in FIG. 1 or FIGS. 2A and 2B.

FIG. 3 is a block diagram showing the arrangement of the control circuit of the printing apparatus. In FIG. 3, reference numeral 1700 denotes an interface for inputting print data; 1701, an MPU; 1702, a ROM storing a control program to be executed by the MPU 1701; 1703, a DRAM for saving data such as print data, and a print signal to be supplied to the printhead; and 1704, a gate array (G.A.) for controlling supply of a print signal to the printhead, and also controlling data transfer between the interface 1700, the MPU 1701, and the DRAM 1703. A controller 600 includes the MPU 1701, ROM 1702, DRAM 1703, and gate array 1704. Reference numeral 1710 denotes a carriage motor for conveying the printhead(s) 11, or 11K, 11C, 11M, and 11Y; 1709, a conveyance motor for conveying a printing sheet; 1705, a head driver for driving the printhead; and 1706 and 1707, motor drivers for driving the conveyance motor 1709 and the carriage motor 1710, respectively.

Note that for the printing apparatus having the arrangement using the full-line printhead as shown in FIG. 1, the carriage motor 1710 and the motor driver 1707 for driving the motor are not arranged, so their reference numerals are parenthesized in FIG. 3.

The operation of the above control arrangement will be explained. When print data is input to the interface 1700, it is converted into a print signal for printing between the gate array 1704 and the MPU 1701. Then, the motor drivers 1706 and 1707 are driven. At the same time, the printhead is driven in accordance with the print data sent to the head driver 1705, thereby performing printing. Information of a transfer error (to be described later) obtained by the printhead is fed back to the MPU 1701 via the head driver 1705 and reflected in printing control.

<Driving Principle of Print Element (FIG. 4)>

Figure 4:
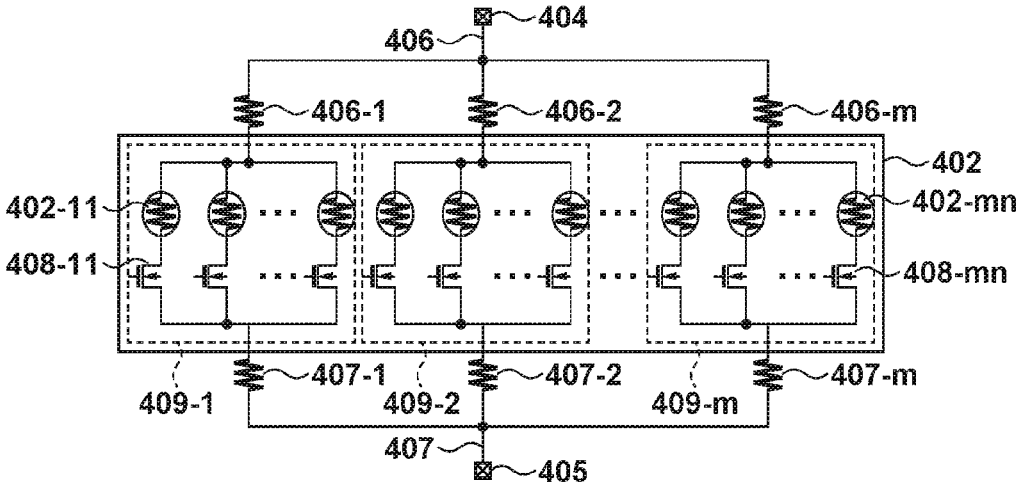
FIG. 4 is a circuit diagram showing the arrangement of driving circuits for driving print elements.

FIG. 4 is a circuit diagram showing a circuit arrangement including print elements and transistors serving as driving circuits for driving the print elements.

As shown in FIG. 4, a print element array 402 is formed from m×n print elements which are divided into m groups 409-1 to **409-*m* each including n print elements. The ground side of each print element 402-*ij* is connected to an NMOS 408-*ij* where i=1, . . . , m and j=1, . . . , n. Therefore, in the arrangement shown in FIG. 4, the jth print element and NMOS of the ith group can generally be represented by 402**-*ij* and 408-*ij*, respectively.

The sources of NMOSs 408-*m*1 to 408-*mn* of the mth group are connected to a common ground wiring 407-*m*. Ground wirings 407-1 to 407-*m* are connected to a ground wiring 407 near an electrode pad 405 of the ground, and the ground wiring 407 is electrically connected to the electrode pad 405. On the other hand, print elements 402-*m*1 to 402-*mn* of the mth group are connected to a power supply wiring 406-*m*, and power supply wirings 406-1 to 406-*m* are connected to a power supply wiring 406 near an electrode pad 404, and the power supply wiring 406 is electrically connected to the electrode pad 404 for externally supplying power.

When the printing apparatus (not shown) transmits print data, and a driving voltage is applied to the gate of each NMOS 408-*ij*, a current flows through the corresponding print element 402-*ij*, and heat energy is supplied to ink, thereby discharging ink from an orifice. Voltage drops in the power supply wiring 406 and the ground wiring 407 are equal to each other regardless of the number of concurrently driven print elements by performing time-divisional drive of concurrently driving up to one print element of the same group during one block time.

In a source-follower structure in which the source of each NMOS 408-*ij* is connected to a power supply voltage, when a driving voltage is applied to the gate of each NMOS 408-*ij*, the print element is driven. Alternatively, in an arrangement in which an NMOS and a PMOS are respectively arranged on two sides of the print element, when a driving voltage is applied to the gates of both the transistors, the print element is driven.

Although embodiments will be described below based on the circuit arrangement shown in FIG. 4, the arrangement of the driving circuits of the print elements is not limited to this.

Some embodiments of the element substrate of the printhead mounted on the printing apparatus having the above arrangement will now be described.

First Embodiment

Figure 5:
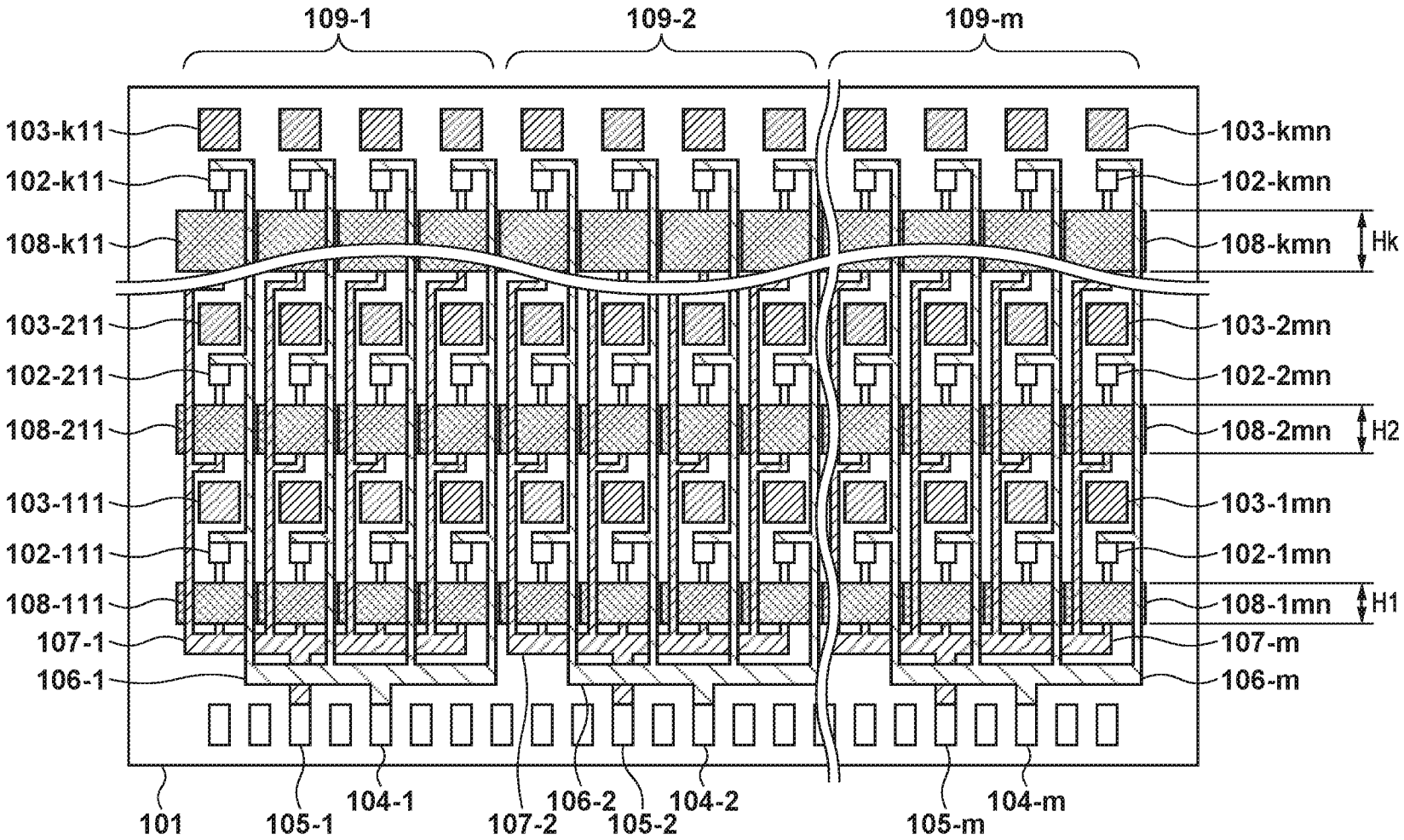
FIG. 5 is a view showing an element substrate 101 according to the first embodiment.
Figure 6:
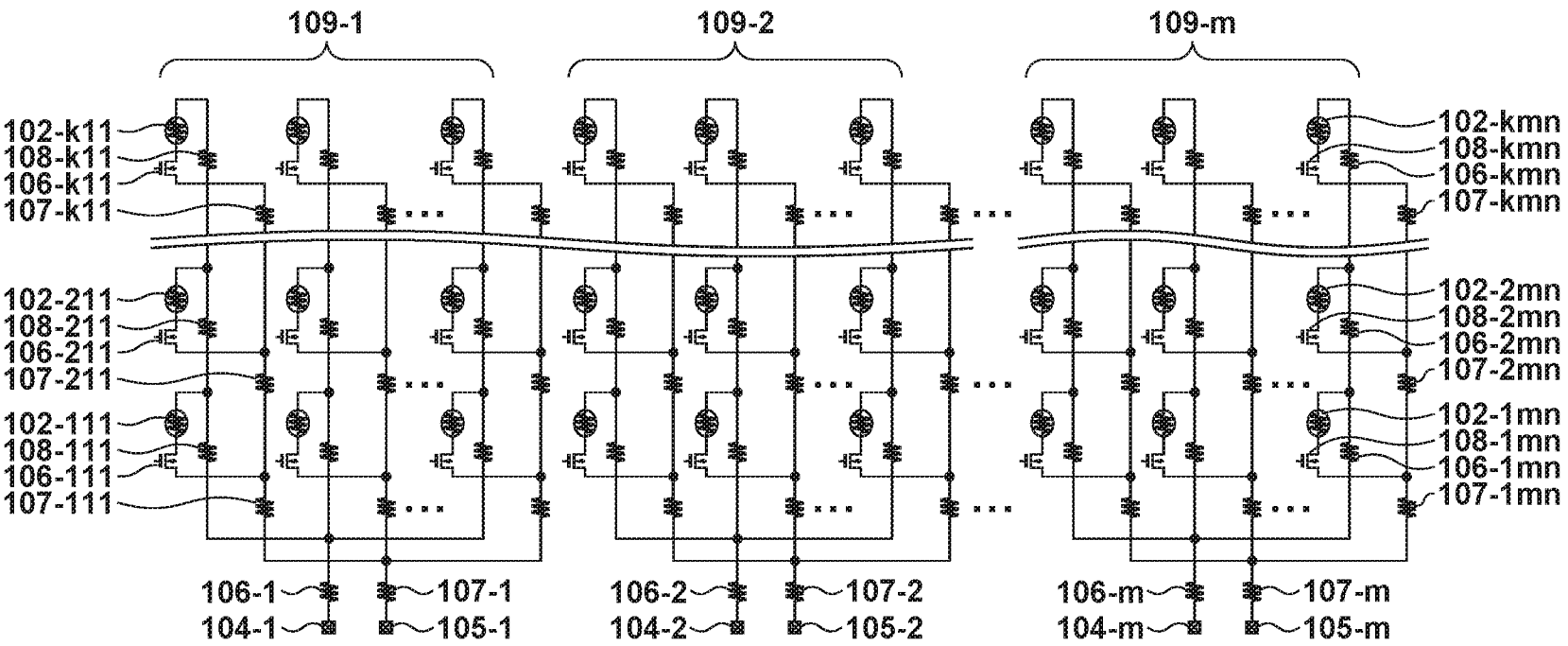
FIG. 6 is a circuit diagram showing a driving circuit arrangement according to the first embodiment.

FIG. 5 is a view showing an element substrate 101 according to the first embodiment. FIG. 6 is a circuit diagram showing a driving circuit arrangement according to the first embodiment. In the arrangement shown in FIGS. 5 and 6, k print element arrays are arranged in parallel, and each print element array includes m×n print elements formed in a matrix pattern. In correspondence with the print elements, NMOS transistors for driving the print elements are formed in a matrix pattern. The print elements of each print element array are arranged at an interval (for example, 600 dpi) of the print resolution of the printing apparatus, and divided into m groups 109-1 to 109-*m* each including n neighboring print elements. Up to one print element is selected from each group to perform time-divisional drive.

In the arrangement according to the first embodiment, the nth print element of the mth group of the kth array is represented by 102-*kmn*. Therefore, an arbitrary print element is generally represented by 102-*hij* where h=1, . . . , k, i=1, . . . , m, and j=1, . . . , n. In this embodiment, the print element 102-*km*1 will be described.

An ink supply port 103-*km*1 is formed in correspondence with the print element 102-*km*1, and supplies ink via a common fluid channel (not shown). A power supply voltage is supplied from an electrode pad 104-*m* to the print element 102-*km*1 via a power supply wiring 106-*m*. The power supply wiring 106-*m* is commonly connected to the print elements of the plurality of arrays (h=1, . . . , k) from a portion between ink supply ports 103-1*m*1 and 103-1*m*2 to a portion between ink supply ports 103-*km*1 and 103-*km*2. Similarly, a ground voltage is connected from an electrode pad 105-*m* to a transistor 108-*km*1 via a ground wiring 107-*m*. The ground wiring 107-*m* is commonly connected to the plurality of arrays (h=1, . . . , k) from a portion between ink supply ports 103-1(*m*−1)n and 103-1*m*1 to a portion between ink supply ports 103-*k*(m−1)n and 103-*km*1. The power supply wirings 106-*m* and the ground wirings 107-*m* of the same group are connected near corresponding pads, respectively. By connecting a plurality of wirings near a pad, the resistance value in a common wiring becomes small to the extent that it can be ignored.

When a driving power is applied to the gate of the transistor 108-*km*1, a current flows through the print element 102-*km*1 to generate heat, and ink is discharged from an orifice (not shown). To avoid a difference in voltage drop from occurring by concurrently driving the plurality of print elements, time divisional drive is performed not to concurrently drive the print elements (for example, the print elements 102-1*m*1 to 102-*km*1) commonly connected between the arrays. Note that two ink supply ports may be formed in correspondence with one print element, and the present invention is not limited to the arrangement shown in FIG. 5.

In the arrangement shown in FIG. 5, the print elements 102-*hij* are connected by the common power supply wiring 106-*i* (i=1, . . . , m) between the arrays. Consequently, a difference occurs between wiring resistances from the electrode pad 104-*i* (i=1, . . . , m) of the power supply voltage to the print elements 102-*hij*. The resistance of the power supply wiring of the print element 102-*km*1 is given by the sum of the resistances of the power supply wirings 106-1*m*1 to 106-*km*1, and the resistance of the power supply wiring of the print element 102-1*m*1 is given by only the resistance of the power supply wiring 106-1*m*1. Similarly, since the ground is connected to the transistors 108-*hij* by the common ground wiring 107-*i* (i=1, . . . , m) between the arrays, a difference occurs between wiring resistances from the electrode pad 105-*i* (i=1, . . . , m) to the transistors 108-*hij*.

Figure 7A:
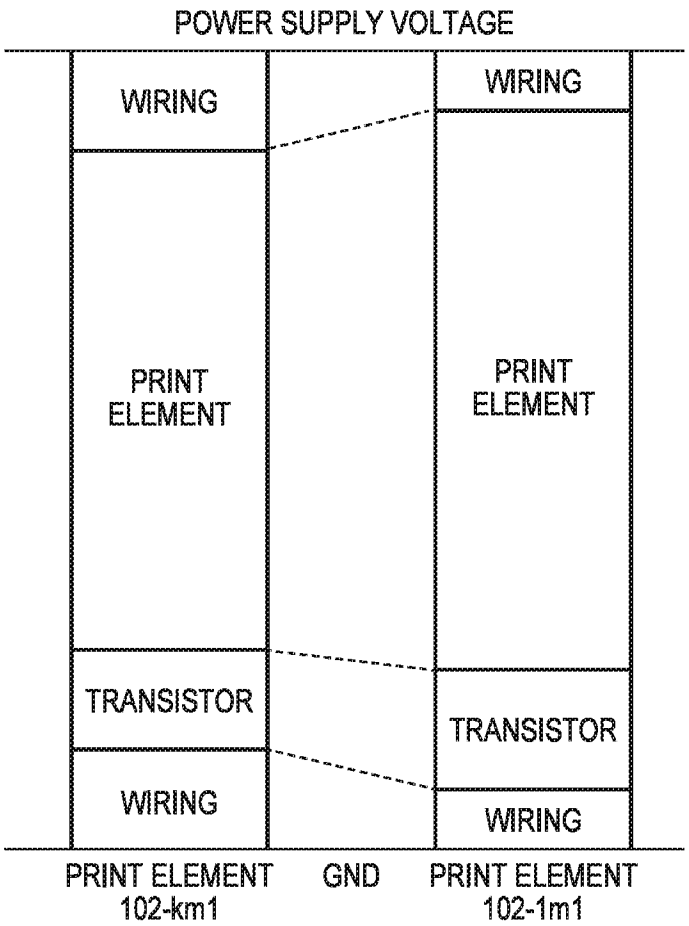
FIGS. 7A and 7B are views each showing a breakdown of a voltage associated with each element with respect to a power supply voltage.
Figure 7B:
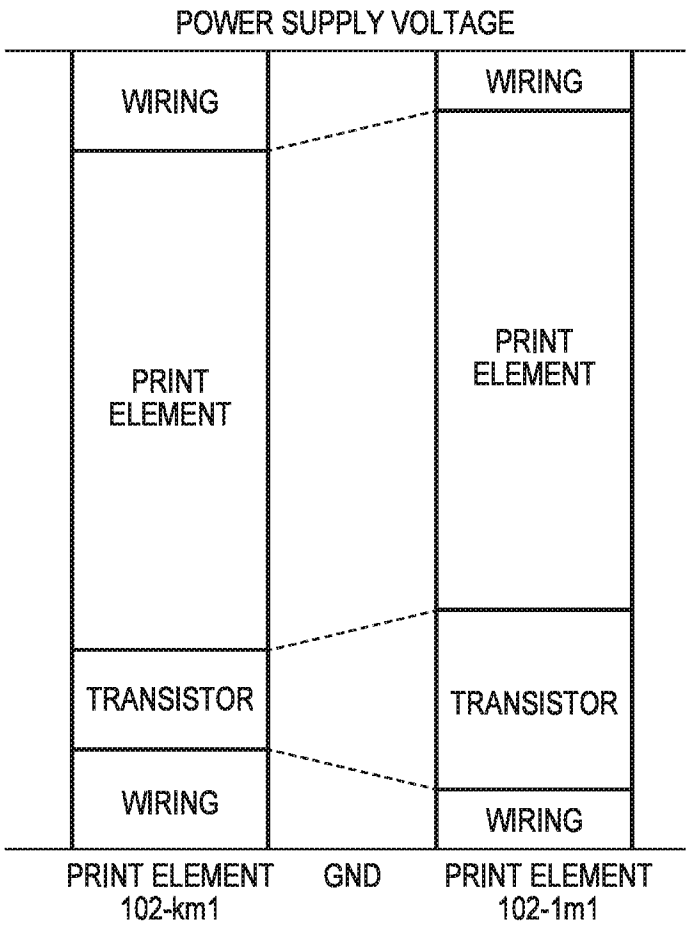

FIGS. 7A and 7B are views each showing a breakdown of a voltage associated with each element with respect to the power supply voltage. FIG. 7A shows a conventional example, and FIG. 7B shows an example according to this embodiment.

As shown in FIG. 7A, according to the conventional example, in the print element 102-*km*1 away from the electrode pad, the wiring resistance is high and a voltage applied to the print element is low. On the other hand, in the print element 102-1*m*1 close to the electrode pad, the wiring resistance is low and a voltage applied to the print element is high. As described above, according to the conventional example, a voltage applied to the print element is different between the arrays, resulting in a change in discharge characteristics.

To the contrary, according to this embodiment, as shown in FIG. 5, the transistor for driving the print element whose wiring resistance (the sum of the resistances of the power supply wiring and ground wiring) to an electrode pad is low is formed to have a small area. More specifically, while maintaining the area of the transistor 108-*km*1 necessary for driving with respect to the print element 102-*km*1, similarly to the conventional example, the area of the transistor 108-1*m*1 is made small with respect to the print element 102-1*m*1. In a case where the area of the transistor decreases, an on-resistance increases, and a voltage applied to the print element decreases accordingly. The difference in wiring resistance between the print element arrays is fit in by an increase in on-resistance caused by changing the area of the transistor.

As shown in FIG. 5, in this embodiment, the size of the transistor is changed in a print element array direction. More specifically, with respect to the print element array direction, let Hk be the size of the transistors of the kth array, . . . , H2 be the size of the transistors of the second array, and H1 be the size of the transistors of the first array. Then, Hk> . . . >H2>H1 holds. In this way, as the distance from the electrode pad is longer, the size of the transistor is larger, and the area of the transistor is also larger.

According to the above-described embodiment, as will be apparent by comparing a voltage applied to the print element 102-*km*1 with that applied to the print element 102-1*m*1 in FIG. 7B, it is possible to apply a constant voltage to the print elements between the print element arrays in accordance with the wiring resistance values from the electrode pad. This makes it possible to obtain stable discharge characteristics in the print elements. By decreasing the size of the transistor in the print element array direction to change the area of the transistor, the wiring length from the electrode pad to the print element becomes short, thereby making it possible to reduce the wiring resistance value and shorten the width of the element substrate.

Note that in this embodiment, the element substrate having a multiplayer structure is used, and the transistors are formed by Al in the first layer, the ground wirings are formed by Al in the second layer, and the power supply wirings are formed by Al in the third layer. However, wirings may be formed in the same layer via through-holes. Electrode pads may be arranged on two sides of the element substrate instead of one side of the element substrate. In this case as well, it is possible to apply a constant voltage to the print elements by changing the areas of the transistors in accordance with the resistance values from the electrode pad.

Second Embodiment

Figure 8:
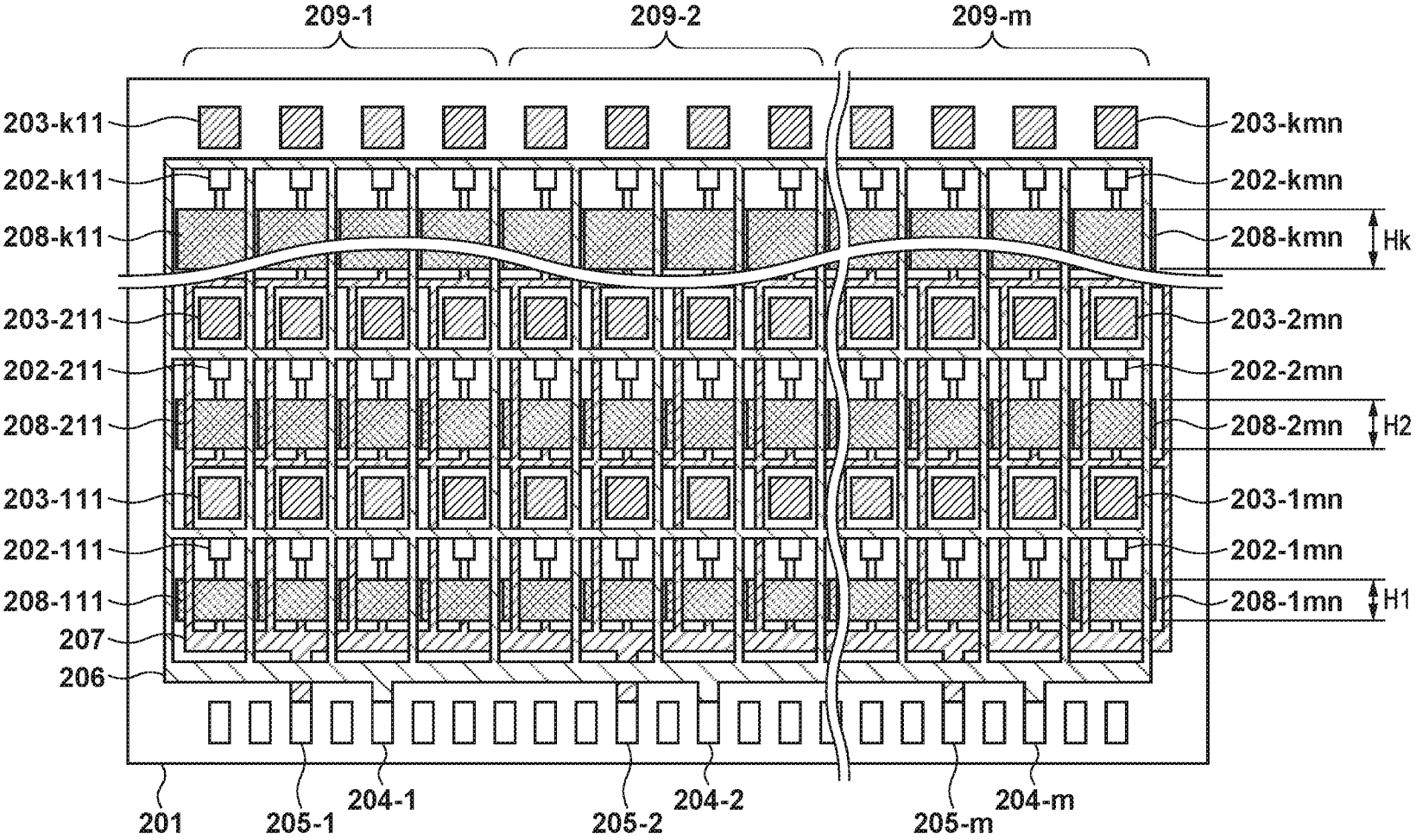
FIG. 8 is a view showing an element substrate according to the second embodiment.
Figure 9:
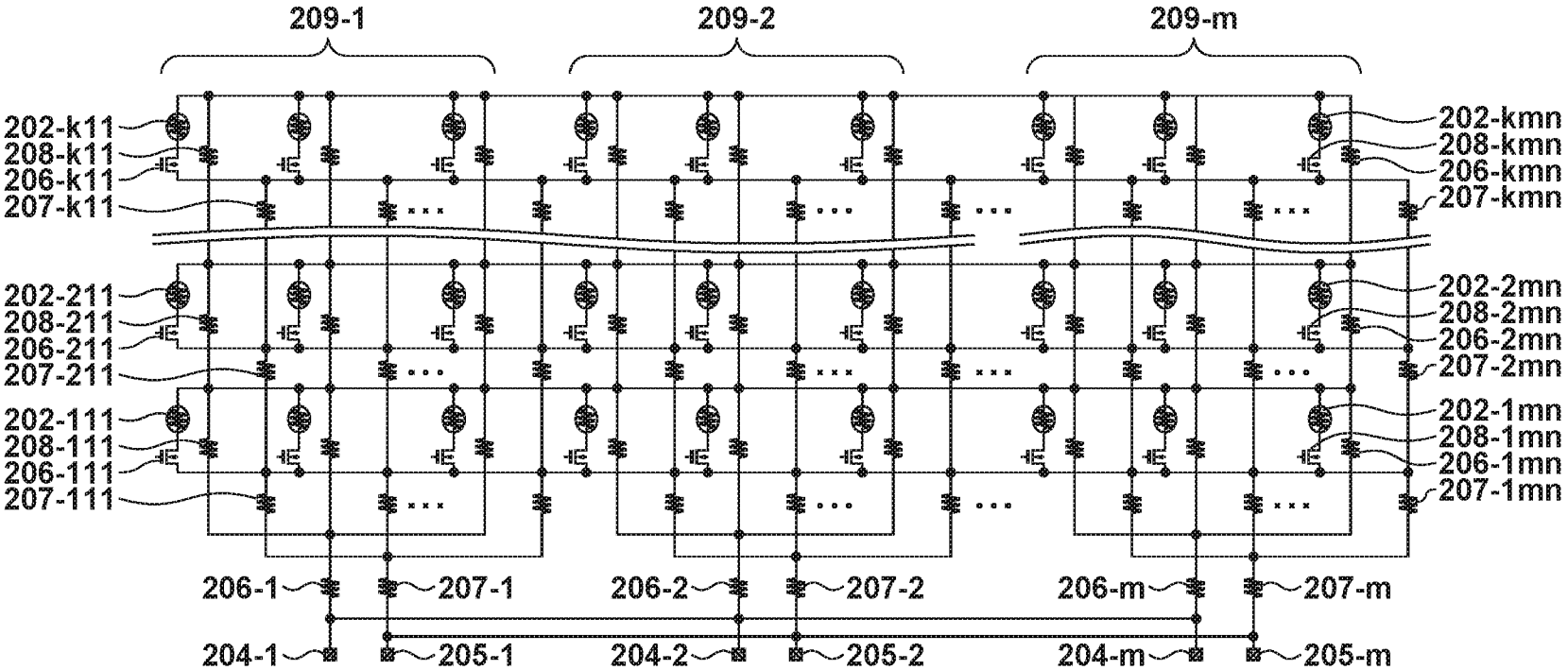
FIG. 9 is a circuit diagram showing a driving circuit arrangement according to the second embodiment.

FIG. 8 is a view showing an element substrate according to the second embodiment. FIG. 9 is a circuit diagram showing a driving circuit arrangement according to the second embodiment. By comparing the arrangement shown in FIGS. 8 and 9 with that shown in FIGS. 5 and 6 described in the first embodiment, only wirings are different and other arrangements and components are the same. A description of the common components in FIGS. 8 and 9 will be omitted, and reference numerals 2*xx-yyy* are used in the second embodiment instead of reference numerals 1*xx-yyy* in the first embodiment to indicate the components according to the second embodiment.

In the second embodiment, power supply wirings 206 and ground wirings 207 are connected in a grid pattern between print elements 202-*hij* and ink supply ports 203-*hij* so as to connect all print elements in an element substrate 201. With this arrangement, for example, even if print elements 202-*k*11 and 202-211 whose print element arrays are different are concurrently driven, the wirings are connected in a grid pattern, and thus a current is not concentrated but distributed to a portion where a resistance is low. Electrode pads 204-1 to 204-*m* and ground pads 205-1 to 205-*m* are commonly connected via the power supply wirings 206 and ground wirings 207. With this arrangement, even if the number of concurrently driven print elements changes in a print element array direction, a current is distributed and thus a voltage drop caused by the wiring resistance remains unchanged.

According to the above-described embodiment, in the wiring arrangement, the area of the transistor gradually decreases from a transistor 208-*k*11 to a transistor 208-111. It is, therefore, possible to apply a constant voltage to the print elements between the print element arrays, thereby obtaining stable discharge characteristics in the print elements. In addition, by decreasing the size of the element substrate in the print element array direction to change the area of the transistor, the wiring length from the electrode pad to the print element can be shortened to reduce the wiring resistance value, thereby reducing the size of the element substrate.

Note that electrode pads may be arranged on two sides of the element substrate instead of one side of the element substrate. In this case as well, it is possible to apply a constant voltage to the print elements by changing the areas of the transistors in accordance with the resistance values from the electrode pad. Furthermore, the power supply wirings and ground wirings need not be connected to all the print elements in the element substrate. For example, the print elements may be divided into a plurality of groups 209-1 to 209-*m*, and power supply wirings and ground wirings may be connected in a grid pattern in each group.

Third Embodiment

Figure 10:
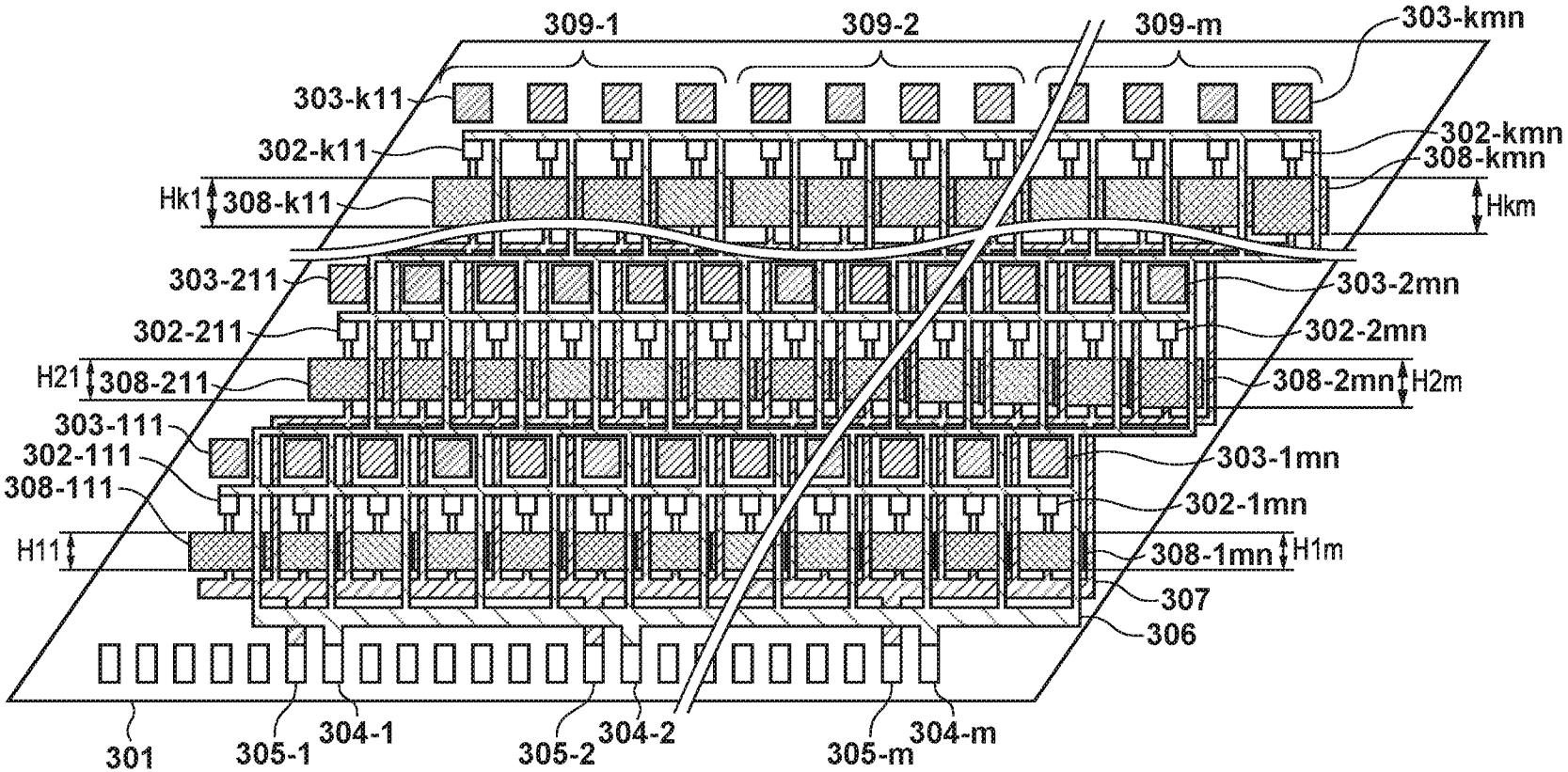
FIG. 10 is a view showing an element substrate according to the third embodiment.
Figure 11:
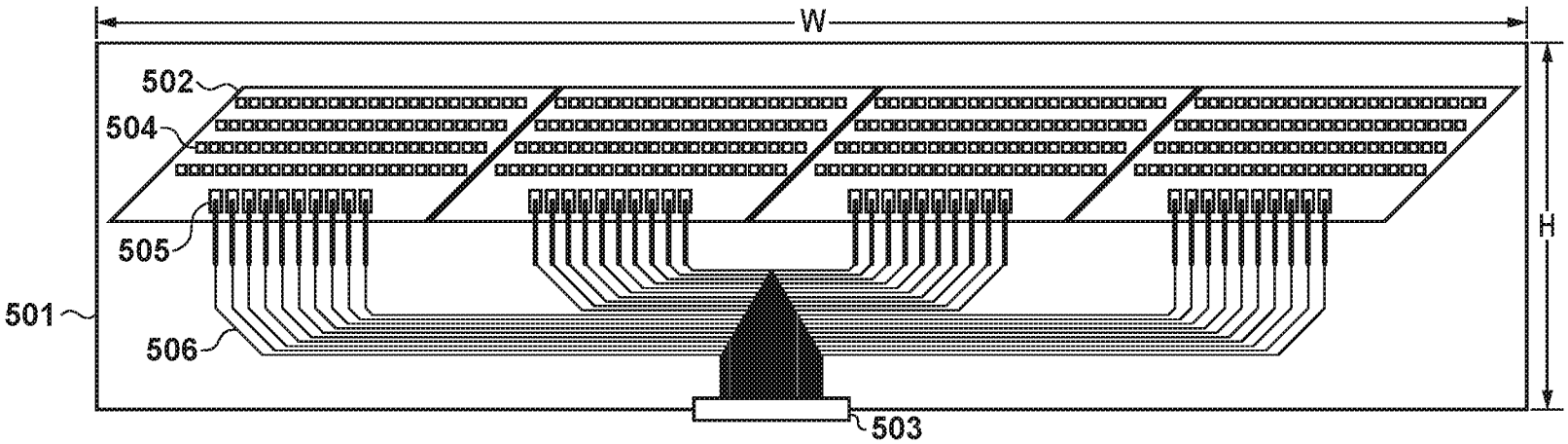
FIG. 11 is a view showing the arrangement of a full-line printhead formed by arranging a plurality of element substrates in line in a printing width direction.
Figure 12:
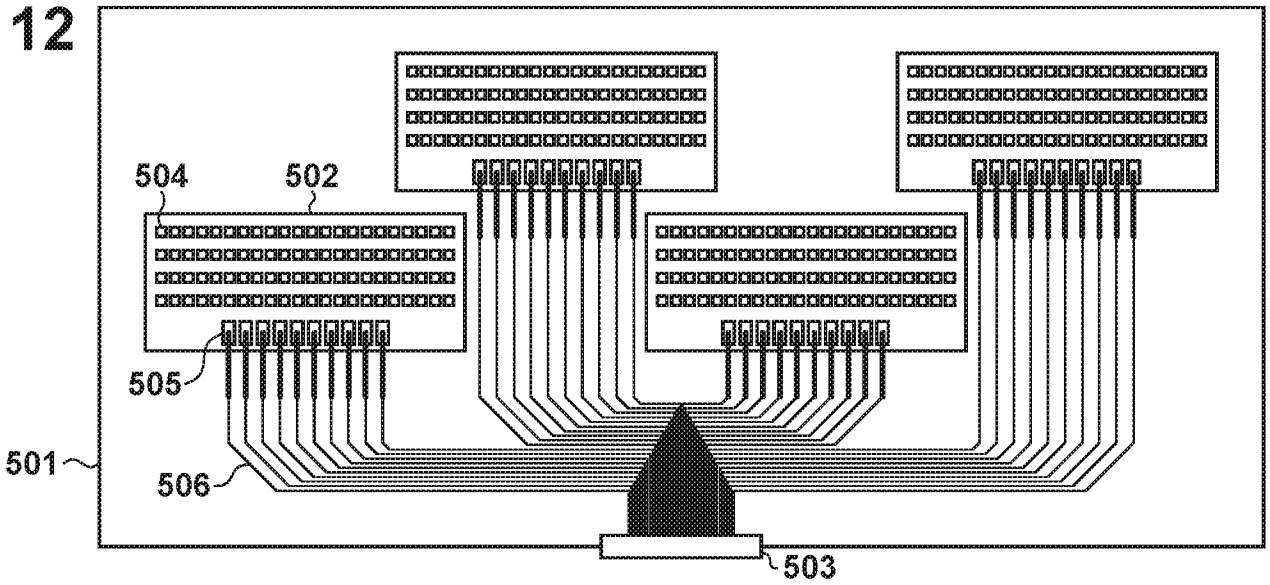
FIG. 12 is a view showing the arrangement of a full-line printhead formed by arranging the plurality of element substrates in a staggered pattern in the printing width direction.

FIG. 10 is a view showing an element substrate according to the third embodiment. As will be apparent from FIG. 10, the shape of an element substrate 301 is a parallelogram, and print elements, wirings, and transistors are arranged in the element substrate 301 in accordance with the shape. A driving circuit arrangement according to this embodiment is the same as that shown in FIG. 9 described in the second embodiment. By comparing the arrangement shown in FIG. 10 with that shown in FIG. 8 described in the second embodiment, the layout of respective components and wirings is different along with the change of the shape of the element substrate but the respective components and wirings are the same. In FIG. 10, therefore, a description of the components and wirings will be omitted, and reference numerals 3*xx* and 3*xx-yyy* are used in the third embodiment instead of reference numerals 2*xx* and 2*xx-yyy* in the second embodiment to indicate the components according to the third embodiment.

Similarly to the second embodiment, in the third embodiment, power supply wirings 306 and ground wirings 307 are connected in a grid pattern between print elements 302-*hij* and ink supply ports 303-*hij* so as to connect all print elements in the element substrate 301. With this arrangement, for example, since a current flowing through the wirings is distributed, there is no difference in voltage drop caused by a wiring resistance between print elements 302-*h*1*j* of a group 309-1, as in the second embodiment. On the other hand, since the print elements 302-*hmj* of a group 309-*m* are limited in terms of a current flow channel by the shape of the element substrate 301, a current is not distributed, thereby increasing a wiring resistance, as compared with other groups.

To cope with this, in this embodiment, even in the same print element array, the areas of the transistors are changed in the group 309-*m*. For example, a transistor 308-*kmn* for driving a print element 302-*kmn* is formed to have an area larger than those of other transistors 308-*k*11 to 308-*km*(*n*−1) of the kth array. This can apply a constant voltage to the print elements even if there are differences in resistances of the power supply wiring and ground wiring between the print elements of the group 309-*m*.

As shown in FIG. 10, in this embodiment, the size of the transistor is changed in a print element array direction and a group division direction. More specifically, letting Hk1 be the size of the first (11) transistor of the kth array and Hkm be the size of the (m×n)th (mn) transistor of the kth array with respect to the print element array direction, Hk1<Hkm. Furthermore, letting H21 be the size of the first (11) transistor of the second array and H2*m* be the size of the (m×n)th (mn) transistor of the second array, H21<H2*m*. Similarly, letting H11 be the size of the first (11) transistor of the first array and H1*m* be the size of the (m×n)th (mn) transistor of the first array, H11<H1*m*. In this embodiment, Hkm> . . . >H2*m*>H1*m* and Hk1> . . . >H21>H11. In this way, as the distance from the electrode pad is longer and the distance to an end portion of the parallelogram is shorter, the size of the transistor is larger.

Furthermore, the size of the transistor for driving the print element close to the end portion of the parallelogram closer to the electrode pad may be further decreased. For example, the area of a transistor 308-111 for driving a print element 302-111 is formed to be smaller than those of transistors 308-112 to 308-1*m*(*n*−1) of the first array. This hardly contributes to making uniform the discharge characteristics since a wiring resistance is low and a voltage drop is small in the print element close to the electrode pad.

According to the above-described embodiment, by changing the area of the transistor in the print element array direction and group division direction, it is possible to obtain stable discharge characteristics in each print element even if the shape of the element substrate is a parallelogram. In addition, by decreasing the size of the transistor in the print element array direction to change the area of the transistor, the wiring length from the electrode pad to the print element can be shortened, thereby making it possible to reduce the wiring resistance value and reduce the size of the element substrate.

Note that electrode pads may be arranged on two sides of the element substrate instead of one side of the element substrate. In this case as well, it is possible to apply a constant voltage to the print elements by changing the areas of the transistors in accordance with the resistance values from the electrode pad. Furthermore, the power supply wirings and ground wirings need not be connected to all the print elements in the element substrate. For example, the print elements may be divided into a plurality of groups 309-1 to 309-*m*, and power supply wirings and ground wirings may be connected in a grid pattern in each group.

In addition, the shape of the element substrate need not be a parallelogram, and the element substrate may have a different shape such as a trapezoid or hexagon.

In the above-described three embodiments, the element substrate is integrated in the printhead for discharging ink to perform printing, and the printhead is mounted on the printing apparatus. However, the element substrate need not always be used for the printhead or printing apparatus. For example, the element substrate may be integrated in a liquid discharge head for discharging a drug or liquid. In this case, the print element is more generally called an electrothermal transducer (heater), and the print element array is an electrothermal transducer array (heater array).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-001072, filed Jan. 6, 2015, which is hereby incorporated by reference herein in its entirety.

What is claimed is:

1. An element substrate comprising a plurality of heater arrays arranged in parallel and each formed by arranging a plurality of heaters, a plurality of transistors corresponding to the plurality of heaters included in the plurality of heater arrays and configured to drive the plurality of heaters, a first electrode pad configured to supply a voltage to be applied to the plurality of heaters, a second electrode pad configured to ground the plurality of heaters, a first wiring configured to connect the first electrode pad to the plurality of heaters, and a second wiring configured to connect the plurality of heaters to the second electrode pad, wherein sizes of the plurality of transistors included in the heater array, of the plurality of heater arrays, provided at a position where intervals with respect to the first electrode pad and the second electrode pad are relatively large are set to be larger than sizes of the plurality of transistors included in the heater array provided at a position where the intervals with respect to the first electrode pad and the second electrode pad are relatively small.

2. The element substrate according to claim 1, wherein the sizes of the plurality of transistors change a size in a direction in which the plurality of heater arrays are arranged.

3. The element substrate according to claim 1, wherein in correspondence with the plurality of heaters, a plurality of supply ports each configured to supply a liquid are provided near the plurality of corresponding heaters, respectively.

4. The element substrate according to claim 3, wherein the first wiring and the second wiring are provided between the plurality of supply ports.

5. The element substrate according to claim 3, wherein the first wiring and the second wiring are formed in a grid pattern between the plurality of supply ports, and connected to the plurality of heaters.

6. The element substrate according to claim 1, wherein the plurality of heaters included in the plurality of heater arrays are divided into a plurality of groups for each heater array, and a plurality of first electrode pads, a plurality of first wirings, a plurality of second electrode pads, and a plurality of second wirings are provided in correspondence with the divided groups, and the plurality of first wirings and the plurality of second wirings are connected to the heaters included in the corresponding groups.

7. The element substrate according to claim 1, wherein the plurality of corresponding transistors are changed in size and formed in a direction in which the plurality of heaters included in each of the plurality of heater arrays are arranged.

8. The element substrate according to claim 7, wherein a shape of the element substrate is a parallelogram, and with respect to sizes of the plurality of transistors included in the heater array provided away from the first electrode pad and the second electrode pad, the transistors provided close to an end portion of the parallelogram are formed to have sizes larger than sizes of the transistors which are not provided close to the end portion.

9. The element substrate according to claim 8, wherein with respect to sizes of the plurality of transistors included in the heater array provided close to the first electrode pad and the second electrode pad, the transistors provided close to another end portion of the parallelogram are formed to have sizes smaller than sizes of the transistors which are not provided close to the another end portion.

10. A liquid discharge head comprising:

an element substrate comprising:

a plurality of heater arrays arranged in parallel and each formed by arranging a plurality of heaters;

a plurality of transistors corresponding to the plurality of heaters included in the plurality of heater arrays and configured to drive the plurality of heaters;

a first electrode pad configured to supply a voltage to be applied to the plurality of heaters;

a second electrode pad configured to ground the plurality of heaters;

a first wiring configured to connect the first electrode pad to the plurality of heaters; and a second wiring configured to connect the plurality of heaters to the second electrode pad, whereby forming a head discharging liquid, wherein sizes of the plurality of transistors included in the heater array, of the plurality of heater arrays, provided at a position where intervals with respect to the first electrode pad and the second electrode pad are relatively large are set to be larger than sizes of the plurality of transistors included in the heater array provided at a position where the intervals with respect to the first electrode pad and the second electrode pad are relatively small.

11. The liquid discharge head according to claim 10, wherein the liquid is ink, and the liquid discharge head is used as an inkjet printhead configured to discharge ink to perform printing.

12. The liquid discharge head according to claim 11, wherein a full-line printhead having a printing width corresponding to a width of a print medium is formed by arranging a plurality of the element substrates in a direction of the plurality of heater arrays.

13. A printing apparatus for performing printing using an inkjet printhead performing printing by discharging ink, wherein the inkjet printhead includes an element substrate comprising:

a plurality of heater arrays arranged in parallel and each formed by arranging a plurality of heaters;

a plurality of transistors corresponding to the plurality of heaters included in the plurality of heater arrays and configured to drive the plurality of heaters;

a first electrode pad configured to supply a voltage to be applied to the plurality of heaters;

a second electrode pad configured to ground the plurality of heaters;

a first wiring configured to connect the first electrode pad to the plurality of heaters; and a second wiring configured to connect the plurality of heaters to the second electrode pad, wherein sizes of the plurality of transistors included in the heater array, of the plurality of heater arrays, provided at a position where intervals with respect to the first electrode pad and the second electrode pad are relatively large are set to be larger than sizes of the plurality of transistors included in the heater array provided at a position where the intervals with respect to the first electrode pad and the second electrode pad are relatively small.

14. The printing apparatus according to claim 13, wherein the inkjet printhead is a full-line printhead formed by arranging a plurality of the element substrates in a direction of the plurality of heater arrays so that a printing width of the full-line printhead corresponds to a width of a print medium.

* * * * *